United States Patent [19]

Miyazaki et al.

[11] Patent Number: 4,785,507

[45] Date of Patent: Nov. 22, 1988

[54] CLEARER DEVICE FOR BOTTOM DRAFT ROLLER

[75] Inventors: Tsutomu Miyazaki, Kariya; Yoshio Kawasaki; Kenji Negishi, both of Fujieda; Masao Wakai, Shimada; Isao Ono; Isao Arita, both of Hirakata, all of Japan

[73] Assignees: Kabushiki Kaisha Toyoda Jidoshokki Seisakusho, Kariya; Kanpatsu Kogyo Kabishiki Kaisha, Hirakata, both of Japan

[21] Appl. No.: 76,075

[22] Filed: Jul. 21, 1987

[30] Foreign Application Priority Data

Jul. 28, 1986 [JP] Japan ..... 61-177438
Jul. 28, 1986 [JP] Japan ..... 61-115849

[51] Int. Cl.[4] ..... D01H 5/62
[52] U.S. Cl. ..... 19/262; 19/264; 19/265
[58] Field of Search ..... 19/262, 264, 265, 245

[56] References Cited

U.S. PATENT DOCUMENTS

| | | | |
|---|---|---|---|
| 697,212 | 4/1902 | Matteson | 19/262 X |
| 2,711,563 | 6/1955 | Lathauwer | 19/264 X |
| 3,340,577 | 9/1967 | Morrow et al. | 19/265 X |
| 4,406,039 | 9/1983 | Hotz | 19/262 |
| 4,586,212 | 5/1986 | Gasser | 19/262 X |

*Primary Examiner*—Louis K. Rimrodt
*Attorney, Agent, or Firm*—Oblon, Fisher, Spivak, McClelland & Maier

[57] ABSTRACT

A retainer frame supportiing pat type clearer members is arranged in opposed relation to a draft roller. The retainer frame is inserted at both longitudinal end portions thereof into insert grooves of supporting brackets mounted on roller stands or draft roller bearing members placed on the roller stands. The retainer frame is formed by folding a metal plate. Each of the clearer members is formed with stopper lugs at both side edges thereof. With this arrangement, each clearer member may be easily installed into the retainer frame, and a uniform projection of the clearer member from the retainer frame may be maintained.

5 Claims, 3 Drawing Sheets

CLEARER DEVICE FOR BOTTOM DRAFT ROLLER

BACKGROUND OF THE INVENTION

The present invention relates to a pat type clearer device, and more particularly to a pat type clearer device having a clearer member which may be easily and securely mounted in a retainer frame which may be also easily installed in opposition to a bottom draft roller.

It is well known that a clearer device for a bottom draft roller uses a cleaning clearer member formed of leather, rubber, synthetic rubber or laminated non-woven cloth and adapted to contact the circumferential surface of the roller. It is also well known that a pat type clearer device uses a clearer member formed of a relatively thick plate-like material and that the edge of the plate-like clearer member is adapted to contact the circumferential surface of the roller. Generally, the conventional clearer device as mentioned above is arranged per space (stuff) between roller stands, and four to eight (corresponding to the number of spindles in one stuff) clearer members are mounted on one supporting member.

As the clearer device must be cleaned periodically or on occasion, it necessarily must be easily mounted and demounted. Particularly, the pat type clearer device must be supported so that the contact edge of each clearer member may uniformly contact the circumferential surface of the draft roller. Further, in mounting a plurality of clearer members onto the supporting member, it is necessary to true up the edges of the clearer members by using a special jig. Thus, the pat type clearer device requires that it may be easily mounted and demounted to the draft roller, and that all the clearer members may uniformly contact the draft roller to reliably effect a cleaning operation, and that it may be securely retained in place during operation.

SUMMARY OF THE INVENTION

Accordingly, it is an object of the present invention to provide a pat type clearer device which allows clearer members to be reliably mounted to a supporting member without using a special jig.

It is another object of the present invention to provide a pat type clearer device which may be easily mounted and demounted.

It is a further object of the present invention to provide a pat type clearer device which may reliably effect a cleaning operation.

According to the present invention, a retainer frame supporting pat type clearer members is arranged in opposed relation to a draft roller. The retainer frame is inserted at both longitudinal end portions thereof into insert grooves of supporting brackets mounted on roller stands or draft roller bearing members placed on the roller stands. The retainer frame is formed by folding a metal plate. Each of the clearer members is formed with stopper lugs at both side edges thereof. With this arrangement, each clearer member may be easily installed into the retainer frame, and a uniform projection of the clearer member from the retainer frame may be maintained.

DETAILED DESCRIPTION OF THE PREFERRED EMBODIMENTS

Figure 1:
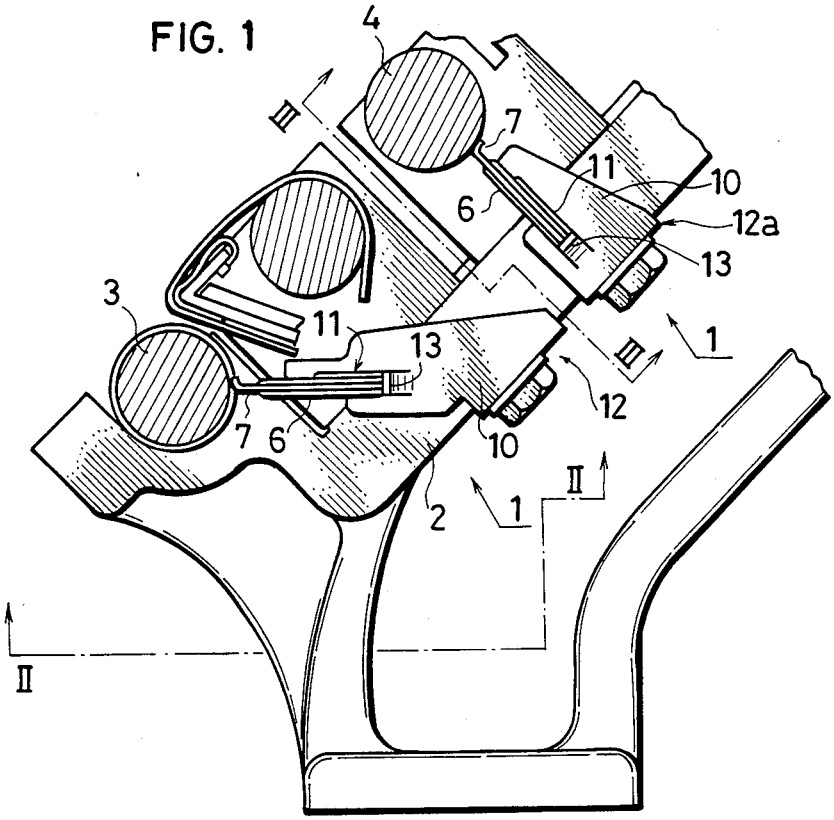
FIG. 1 is a sectional side view of the clearer device of the present invention arranged in opposed relation to a front bottom roller and a third bottom roller.

FIG. 1 shows an exemplary draft apparatus equipped with clearer devices 1 arranged in opposed relation to a front bottom roller 3 and a third bottom roller 4. While the draft apparatus shown is a part of a ring spinning frame, it is similarly applicable to another spinning machine. The clearer device 1 of the present invention may be applied to the front bottom roller 3 only, and another clearer device may be applied to the third bottom roller 4. Alternatively, the clearer device 1 of the present invention may be applied to the third bottom roller 4 or a back roller 5 only, and another clearer device may be applied to the third bottom roller 3.

Figure 5:
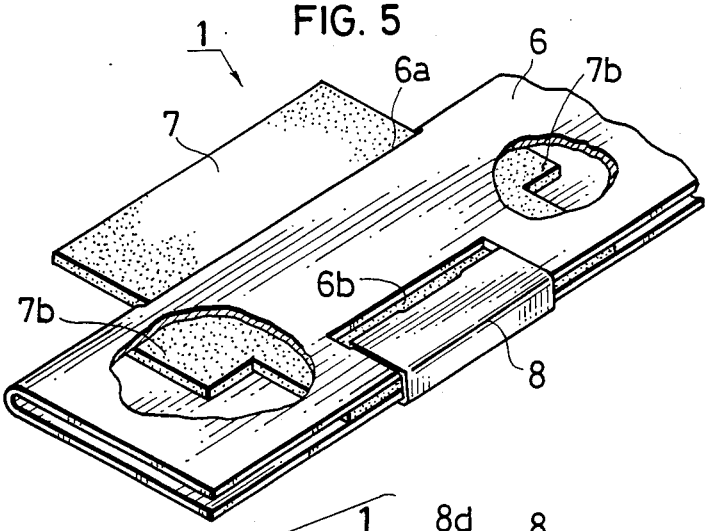
FIG. 5 is a fragmentary view in perspective of the pat type clearer device of the present invention, partially broken away.
Figure 6:
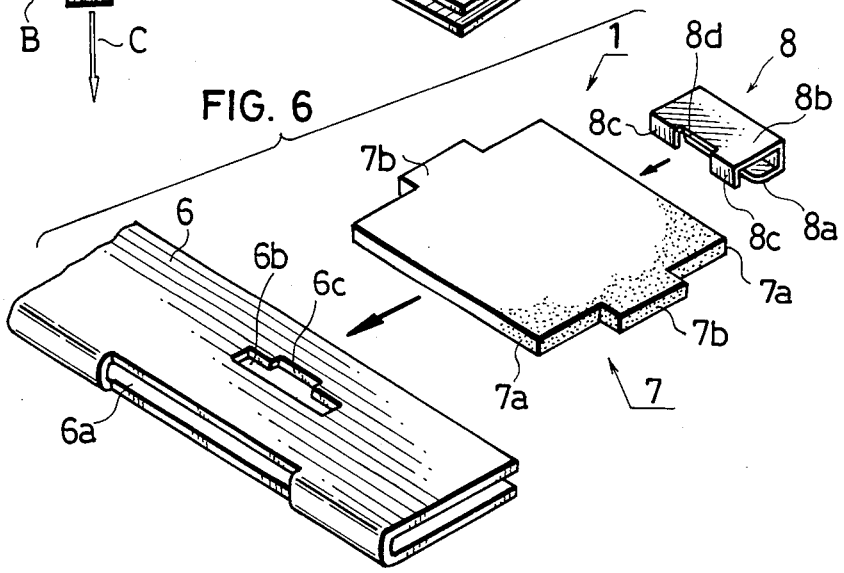
FIG. 6 is an exploded perspective view of the components of the pat type clearer device of the present invention.

Referring to FIGS. 5 and 6, a retainer frame 6 is formed by folding a metal plate cut in a size corresponding to a width of one stuff, with a gap being defined between upper and lower portions of the retainer frame 6 for the purpose of receiving a clearer member 7. The retainer frame 6 is formed at its folded portion with an elongated aperture *6a* having a length corresponding to a width of the clearer member 7. The retainer frame 6 further includes a stopper aperture *6b* formed through either of the upper or lower portion at a position substantially centrally of the elongated aperture *6a*. Both the apertures *6a* and *6b* are formed preferably before folding the metal plate for the retainer frame 6.

Figure 2:
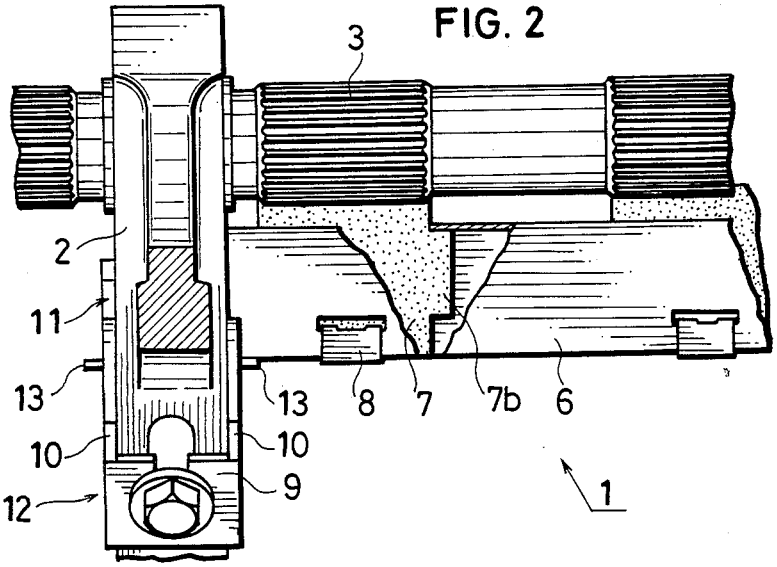
FIG. 2 is a cross section taken along the line II—II in FIG. 1.
Figure 3:
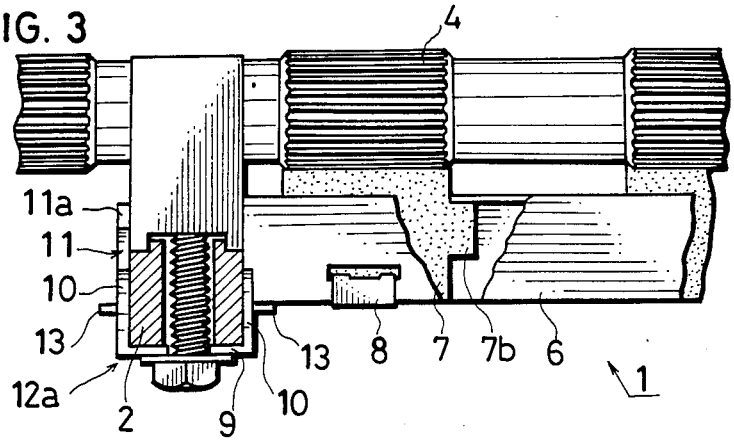
FIG. 3 is a cross section taken along the line III—III in FIG. 1.

The clearer member 7 may be formed of any materials used for a conventional clearer member, but is is preferably formed of a plate-like synthetic rubber material prevented from generating a static electricity and having a relatively high elasticity. As shown in FIG. 6, the clearer member 7 is formed with a pair of lugs *7b* on both sides thereof. Front and rear end surface *7a* of the clearer member 7 are parallel to the lugs *7b*, and are perpendicular to upper and lower surfaces of the clearer member 7. As shown in FIGS. 2 and 3, the front end of the each lug 7*b* functions as a stopper for restricting projection of the clearer member 7 from the elongated aperture 6*a* of the retainer frame 6. Therefore, a distance between the right and left stoppers of the lugs 7*b* is set to be equal to the width of the front end surface 7*a*. Further, it is preferable that when the front end surface 7*a* of the clearer member 7 has been worn or weakened, the clearer member 7 is disengaged from the retainer frame 6 to utilize the rear end surface 7*a*. Therefore, each lug 7*b* is positioned at the center of both the end surfaces 7*a*, and a distance from the front end surface 7*a* to the front end of each lug 7*b* is equal to that from the rear end surface 7*a* to the rear end of each lug 7*b*. The thickness of the clearer member 7 is such that the lugs 7*b* and the end surface 7*a* to be used are permitted to be inserted into the gap of the retainer frame 6.

In installing the clearer member 7 to the retainer frame 6, the clearer member 7 is inserted in the direction as depicted by an arrow in FIG. 6 until the front end surface 7*a* is projected from the elongated aperture 6*a*, and the front end of each lug 7*b* is brought into abutment against the inside surface of the folded portion of the retainer frame 6. Then, an elastic fastener 8 formed of a steel plate shown in FIG. 6 is engaged with the retainer frame 6 on its rear side as shown in FIG. 5. As shown in FIG. 6, the elastic fastener 8 is formed with a tongue portion 8*a*, a first bent portion 8*b* and a pair of second bent portions 8*c* formed at the front end of the first bent portion 8*b*. The tongue portion 8*a* and the first bent portion 8*b* function to sandwich the retainer frame 6. The pair of second bent portions 8*c* are engaged with the stopper aperture 6*b* of the retainer frame 6 to thereby prevent disengagement of the elastic fastener 8, and simultaneously they operate to press the clearer member 7 to thereby stop the movement of the clearer member 7. The stopper aperture 6*b* is formed with a recessed portion 6*c*, and the elastic fastener 8 is formed with a recessed portion 8*d* corresponding to the recessed portion 6*c* between both the second bent portions 8*c*. Both the recessed portions 6*c* and 8*d* function in combination as an engagement portion into which a tool is inserted so as to disengage the elastic fastener 8 from the retainer frame 6.

Figure 4:
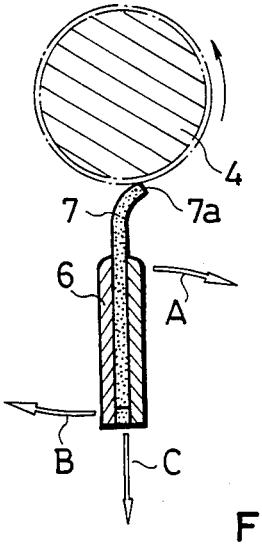
FIG. 4 is a sectional view of the pat type clearer device illustrating the operation.

In the pat type clearer device as mentioned above, when the draft bottom roller 4 is rotated in the direction as depicted by an arrow in FIG. 4, the clearer member 7 elastically contacts the bottom roller 4 in such a manner that one of the two edges of the end surface 7*a* of the clearer member 7 is engaged with one of flutes formed on the circumferential surface of the bottom roller 4. At this time, the retainer frame 6 is securely maintained in this condition, and it is easily detachably mounted. That is, the retainer frame 6 tends to be inclined in the direction of an arrow A by the rotation of the draft bottom roller 4 in the above-mentioned direction. As a result, the retainer frame 6 is reactively moved in the direction of an arrow B, and a contact pressure of the clearer member 7 with the bottom roller 4 is reactively applied in the direction of an arrow C. According to the present invention, there is provided a retainer frame supporting means which may support such a reaction as mentioned above and allow the retainer frame 6 to be easily attached and detached.

Figure 7:
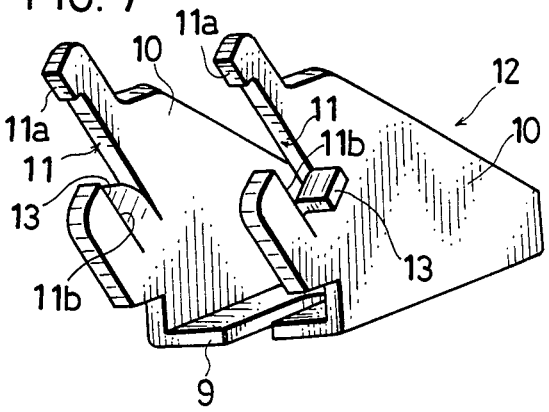
FIG. 7 is a perspective view of the supporting bracket to be arranged for the front roller.
Figure 8:
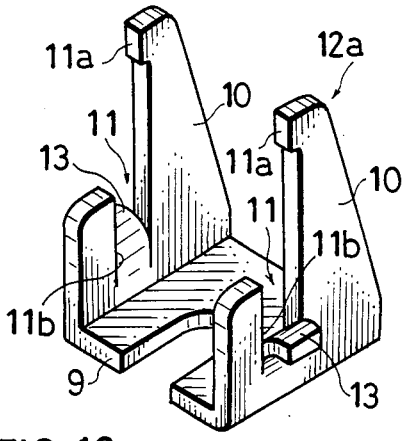
FIG. 8 is a perspective view of the supporting bracket to be arranged for the third roller.

FIG. 1 shows a supporting bracket 12 for supporting the clearer device 1 arranged in opposed relation to the front bottom roller 3 and also shows a supporting bracket 12*a* for supporting the clearer device 1 arranged in opposed relation to the third bottom roller 4. These supporting brackets 12 and 12*a* are best shown in FIGS. 7 and 8. Each of the supporting brackets 12 and 12*a* is formed with a pair of opposed side walls 10 bent from a bottom surface 9, between which side walls 10 a slide portion of a roller stand 2 is interposed. Each of the side walls 10 is formed with an insert groove 11 for receiving the retainer frame 6. The insert groove 11 has a front upper opening so that the retainer frame 6 may easily be inserted thereinto in such a manner as to be inclined with its head down and its tail up. The insert groove 11 is formed with an upper contact portion 11*a* at a rear upper portion thereof, and with a lower contact portion 11*b* at a front lower portion thereof. The bottom of the insert groove 11 may be a mere contact surface contacting the head of the retainer frame 6. However, the bottom surfaces 9 of the supporting brackets 12 and 12*a* to be mounted on the back side of the slide portions of the roller stands 2 are not uniform for all the roller stands 2, and they are not finely finished. Accordingly, it is preferred to form cuts extending from the bottom of the insert groove 11 into the side wall 10 and outwardly bend such a cut portion to form a bent bottom 13. The bent bottom 13 is formed by using an appropriate jig. However, if the clearer member 7 does not properly contact the bottom roller, a quantity of bending of the bent bottom 13 may be modified by utilizing a tool capable of nipping the bent bottom 13 after mounting the supporting bracket, thereby adjusting the contact condition of the clearer member 7. Alternatively, an independent bent piece may be bonded to the side wall 10 by welding or the like. Each bottom surface 9 of the supporting brackets 12 and 12*a* is formed with an elongated recess opened at its one end, through which recess a tightening bolt for a bearing member of the bottom roller is inserted and is tightened to the supporting bracket.

In the embodiment shown in FIG. 1, the supporting brackets 12 and 12*a* are arranged in opposed relation to the front bottom roller 3 and the third bottom roller 4. In particular, while the pat type clearer device 1 opposed to the front bottom roller 3 is disposed substantially horizontally due to positional relationship with the other clearer devices, it may be disposed at substantially right angles to a line of arrangement of the bottom rollers in opposed relation to the third bottom roller 4. Thus, the clearer device may be directed to the axis of the bottom roller at a desired angle by desirably directing the insert grooves 11 of the supporting brackets to the bottom roller. In the embodiment shown in FIGS. 2 and 3, the supporting brackets 12 and 12*a* are mounted on the roller stand 2 positioned intermediate the bottom roller, and the pat type clearer device 1 is located on only the right side of the brackets. Accordingly, although the supporting brackets to be mounted on the other roller stands at their both ends have the same construction as above, either of the side walls 10 of the supporting bracket may be removed.

Figure 9:
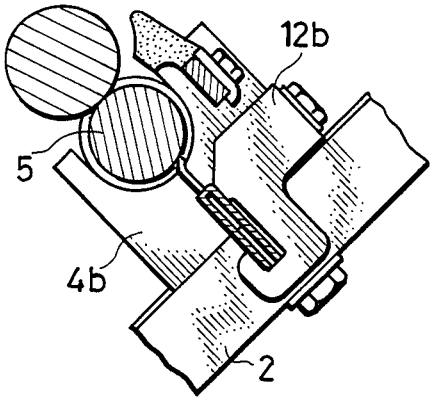
FIG. 9 is a sectional side view of the clearer device of the present invention arranged in opposed relation to the back bottom roller.
Figure 10:
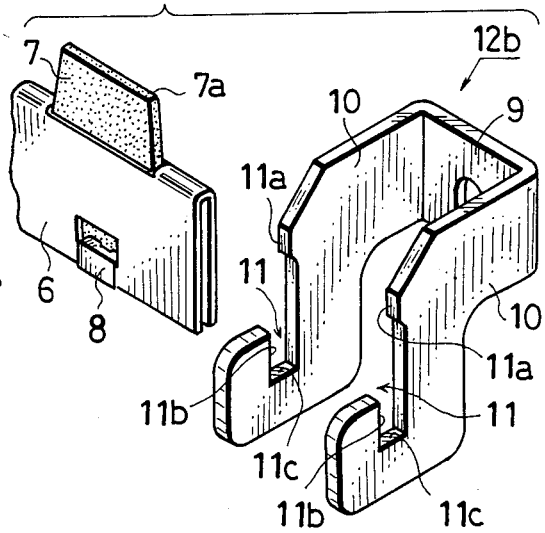
FIG. 10 is a perspective view of the supporting bracket shown in FIG. 9 and an associated fragmentary view in perspective of the clearer device of another preferred embodiment.

Referring to FIG. 9 which shows another embodiment of the present invenitn, the pat type clearer device 1 is arranged in opposed relation to a back bottom roller 5, and a supporting bracket 12*b* is mounted on the rear side of a bearing member 4*b* of the back bottom roller 5. A shown in FIG. 10, the supporting bracket 12*b* includes a bottom surface 9 and a pair of side walls 10 bent from the bottom surface 9. A pair of insert grooves 11 of the supporting bracket 12*b* are formed in the same manner as those of the uspporting brackets 12 and 12*a* as previously mentioned, excepting that each bottom 11*c* of the insert grooves 11 is formed at a fixed depth. That is, the adjustment of contacting of the clearer member 7 with the bottom roller may be carried out by vertically adjusting the supporting bracket 12*b* and tightening same. As also shown in FIG. 10, the width of the clearer member 7 is gradually decreased from the lugs to the end surface 7*a*. That is, the width of the end surface 7*a* is substantially the same as that of a draft part of the bottom roller.

Figure 11:
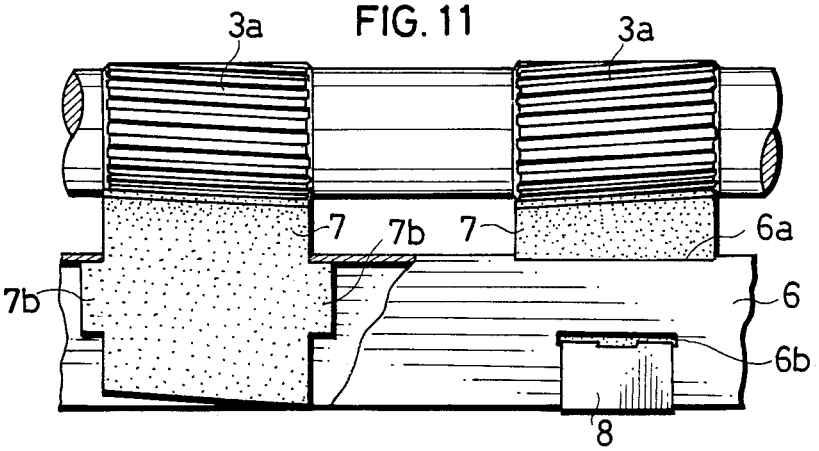
FIG. 11 is a fragmentary view in elevation of the clearer device of a further modified embodiment.

Referring to FIG. 11 which shows a further modified embodiment of the present invention, flutes 3*a* formed on the circumferential surface of the bottom roller are inclined with respect to the axis of the roller, and accordingly the end surface 7*a* of the clearer member 7 has an inclined angle substantially the same as that of the flutes 3*a*. The retainer frame 6 and the supporting bracket are formed in the same manner as the previous embodiments.

According to the present invention, the clearer member may be easily installed into the retainer frame without using a special jig, and may be securely retained. The clearer member is elastically deformable, thereby permitting one of the two edges of the end surface 7*a* of the clearer member 7 to closely contact the draft roller. Both the end support portions of the retainer frame and their upper and lower surfaces are the same in shape. Accordingly, when the contact edge of the clearer member is worn, the retainer frame is overturned at both the end support portions to thereby simultaneously renew all the contact edges. Further, the clearer member may be easily replaced only by releasing the elastic fastener. At this time, the front end surface of the clearer member may be replaced by the rear end surface thereof. Accordingly, totally four edges of one clearer member may be used.

In installing the retainer frame into the supporting bracket mounted on the bottom roller, both end portions of the retainer frame are horizontally inserted into the insert grooves of the supporting brackets. Thus, the installation of the retainer frame may be carried out with great ease. Further, as the clearer member is in elastic abutment against the bottom roller, the retainer frame may be stably supported in the insert grooves. As the contact edge of the clearer member is vibrated by the rotation of the flutes of the roller, a cleaning effect is improved, and deposition of fibers and foreign matters onto the clearer member may be greatly reduced. Furthermore, as the surface of the retainer frame is smooth, deposition of cotton dust or the like onto the retainer frame may be also reduced, thereby keeping the draft part clean. In the case of applying a cleaning air flow from a blow cleaner or the like to the draft part, such a blown air is not hindered from passing from the upper side of the draft part to the lower side thereof, thus serving to maintain the draft part clean.

What is claimed is:

1. A clearer device for a bottom draft roller comprising a clearer assembly comprising a retainer frame having a length corresponding to a distance between roller stands and a clearer member formed of a relatively thick plate-like material, said clearer member being arranged in opposed relation to a draft part of said draft roller and being retained by said retainer frame with one end portion of said clearer member projecting from said retainer frame by a fixed length; and a plurality of supporting brackets mounted on said roller stands for supporting said clearer assembly, said supporting brackets being formed with insert grooves for receiving both longitudinal end portions of said retainer frame from a front upper side of said supporting brackets.

2. The clearer device as defined in claim 1, wherein said retainer frame is formed by folding a metal plate, and said retainer frame is formed with an elongated aperture at a folded portion thereof from which aperture said clearer member is projected, and is further formed with a stopper aperture at one surface of said retainer frame; said clearer device further comprising an elastic fastener designed to be engaged with said retainer frame in such a manner as to sandwich a substantially central portion on an open end side of said retainer frame, said elastic fastener having a bent portion adapted to engage said stopper aperture of said retainer frame.

3. The clearer device as defined in claim 1 or 2, wherein said clearer member is formed with a pair of lugs at central portions on both side edges, and front edges of said lugs are engaged with an inner surface of said folded portion of said retainer frame so as to restrict a projection length of said clearer member.

4. The clearer device as defined in claim 1 or 2, wherein each of said insert grooves comprises a rear upper portion, a front lower portion formed in diagonal relationship to said rear upper portion, and a bottom portion adapted to contact said open end of said retainer frame and stop same.

5. The clearer device as defined in claim 1 or 2, wherein said supporting brackets for supporting said retainer frame are vertically adjustably mounted on rear surfaces of slide bearing blocks for said bottom draft roller.

* * * * *